United States Patent [19]

Park

[11] Patent Number: 4,998,090

[45] Date of Patent: Mar. 5, 1991

[54] ENGINE IGNITION CABLE FOR PREVENTING UNWANTED INTERFERENCE DUE TO HIGH FREQUENCY NOISE

[76] Inventor: Hee W. Park, 134, Jowagon-11, Jinyoung-eup, Kimhae-kun, Kyunsangnam, Rep. of Korea

[21] Appl. No.: 321,087

[22] Filed: Mar. 9, 1989

[30] Foreign Application Priority Data

Sep. 2, 1988 [KR] Rep. of Korea ..... 88-11404

[51] Int. Cl.[5] ..... H01C 3/06

[52] U.S. Cl. ..... 338/214; 338/66; 174/120 SC; 174/102 SC

[58] Field of Search ..... 338/214, 66; 174/102 SC, 120 SC

[56] References Cited

U.S. PATENT DOCUMENTS

| | | | |
|---|---|---|---|
| 4,360,704 | 11/1982 | Madry | 174/102 SC |
| 4,576,827 | 3/1986 | Hastings et al. | 338/214 X |
| 4,800,359 | 1/1989 | Yukawa et al. | 338/214 |
| 4,818,438 | 4/1989 | Wiley | 174/120 SC X |

*Primary Examiner*—Bruce A. Reynolds
*Assistant Examiner*—Marvin M. Lateef
*Attorney, Agent, or Firm*—Lieberman, Rudolph & Nowak

[57] ABSTRACT

An engine ignition cable in which carbon fiber is mixed with conductive rubber or synthetic resin, to provide a conductive portion in which the resistance value is readily adjusted. The conductive element of the cable is made of carbon fiber of polyacrylo nitrile type. The conductive element is coated with an electro-conductive layer comprising a mixture of polyacrylo nitrile type carbon fiber powder and conductive rubber or synthetic resin mixed in accordance with a predetermined ratio to achieve a predetermined resistance value.

4 Claims, 2 Drawing Sheets

ENGINE IGNITION CABLE FOR PREVENTING UNWANTED INTERFERENCE DUE TO HIGH FREQUENCY NOISE

FIELD OF THE INVENTION

The present invention relates to an engine ignition cable designed to prevent unwanted interference due to high frequency noise which occurs when the high voltage (over 20 KV) generated from the ignition coil is supplied to the distributor and the spark plug, and which noise may harm the electrical components of an automobile.

BACKGROUND OF THE INVENTION

The conventional engine ignition cable, connected between the coil, the distributor and the spark plug, is generally made of high electro-conductive metal wire such as copper, and such ignition cables have many advantages. The high conductive metal has low electro-resistance, and can apply the high current generated by the coil to the spark plug, thereby producing powerful sparks which produce excellent ignition capability for the engine.

However, the conventional engine ignition cable has several drawbacks, namely the generation of high frequency noise which adversely effects the electronic components of the automobile, such as the radio, wireless communication components, or the TV. Such high frequency noise is caused by the high current which flows in the high voltage circuit between the ignition coil and the spark plug.

Due to the above mentioned problems, an ignition cable made of metal material cannot be used in many countries and, moreover, the ignition cable material is regulated and uniform by the standards of each country, for example the KS, JIS, SEA and ASTM standards.

The Korean standard (KS), Japan Industrial standard (JIS), and the ASTM standard sets limits on the electro-resistant value of the ignition cable to below 16 Kohm/m, and they rule that the ignition cable is made of a high polymer material. However, the high polymer electro-conductive material which constitutes the conventional ignition cable has several drawbacks in the starting time of the engine.

Generally, the conventional ignition cables can be classified into five groups as shown in FIG. 3:

The fabrication and component parts of the above categories of conventional ignition cables are as follows:

| | |
|---|---|
| D + G portion: | 1. Mix electro-conductive carbon black (CC) with rubber. |
| | 2. Mix carbon black with synthetic resin. |
| G portion: (anti-tension part) | 1. Dip electro-conductive carbon black in glass fiber in order to raise conductivity, or use glass fiber only. |
| | 2. Mix electro-conductive carbon black with aramide fiber or use aramide fiber only |
| E portion: | Use magnetic rubber for preventing the generation of the high frequency noise and extend the length of the cable by winding 0.2 mm-thick metal wire (F) on E portion. |
| A + B portion: | Composed of non-conductive rubber. |
| C portion: | Weave with glass fiber which serves as the anti-tension part of the cable. |

The conventional carbon black is normally used as the electro-conductive material, that is: the conventional acetylene carbon black is used to raise the electro-conductivity. Said acetylene carbon black, consisting of a low molecular weight material, is made by mixing carbon black with rubber and/or synthetic resin. However, the electro-conductivity of the conventional carbon black has a critical value because of a property of matter such as strength and aging characteristics.

That is, if a large amount of carbon black is mixed with rubber or synthetic resin, the property of matter are poor, while on the contrary the electro-conductivity rises. For example, adding a large amount of carbon black results in very poor aging characteristics, as well as expediting the oxidation phenomenon. Also, the bending power of the cable is substantially reduced so that the cable is easily broken and/or very weakened from physical shock.

Moreover, as is apparent in the case where the cable is broken, electricity is not conducted and the function of the ignition cable is lost. Accordingly, because it is difficult to maintain an electro-resistance value of 16 Kohm/m by mixing the carbon black with rubber or synthetic resin, the carbon black is dipped in the aramide fiber, or glass fiber, of the anti-tension part (the G portion) in order to raise conductivity of the ignition cable.

Additional problems with conventional ignition cables include the fact that the electro-conductivity cannot rise satisfactorily because the resistance value of the ignition cable cannot be dropped below 16 Kohm/m. Also, the higher the voltage which is generated from the ignition coil, the resultant higher electro-resistance results in greater adverse aging of the conductive rubber. Moreover, as the electro-resistance becomes higher than 16 Kohm/m, the current is not satisfactorily supplied to the spark plug, and the spark supplied by the spark plug is weakened. This results in the fuel in the cylinder being unsatisfactorily ignited and imperfect combustion gases being emitted in the air. This, of course, causes contamination of the air, as well as a loss of fuel.

It is, therefore, an object of the instant invention to solve the above mentioned problems, while at the same time providing an ignition cable that prevents the occurrence of high frequency noise in a gasoline engine.

SUMMARY OF THE INVENTION

In accordance with the instant invention, the conductive element of an engine ignition cable is made of a polyacrylo nitrile type carbon fiber, and the electro-conductive layer of an engine ignition cable is fabricated by properly mixing the polyacrylo nitrile type carbon fiber powder with conductive rubber or synthetic resin, in an appropriate ratio according to the required resistance value. More particularly, it is a feature of the invention that the electro-conductive layer of the ignition cable attains favorable conductivity and low electroresistance value by coating the surface of the conductive element (anti-tension part) of the ignition cable which is made of the polyacrylo nitrile type carbon fiber. The resistance value is reduced substantially to less than 16 Kohm/m, which is the lowest resistance value of the conventional conductive layer, while at the same time high frequency noise can be prevented. Thus, a strong spark from the ignition plug is generated and perfect combusting of the fuel in the cylinder is attained.

The foregoing and other objects and features of this invention will be more fully understood from the following detailed description of an illustrative embodiment thereof taken in conjunction with the accompanying drawings.

DETAILED DESCRIPTION OF THE INVENTION

Figure 1:
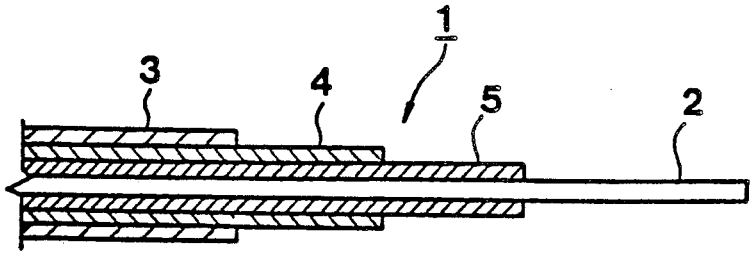
FIG. 1 is a sectional view of the present invention.
Figure 2:
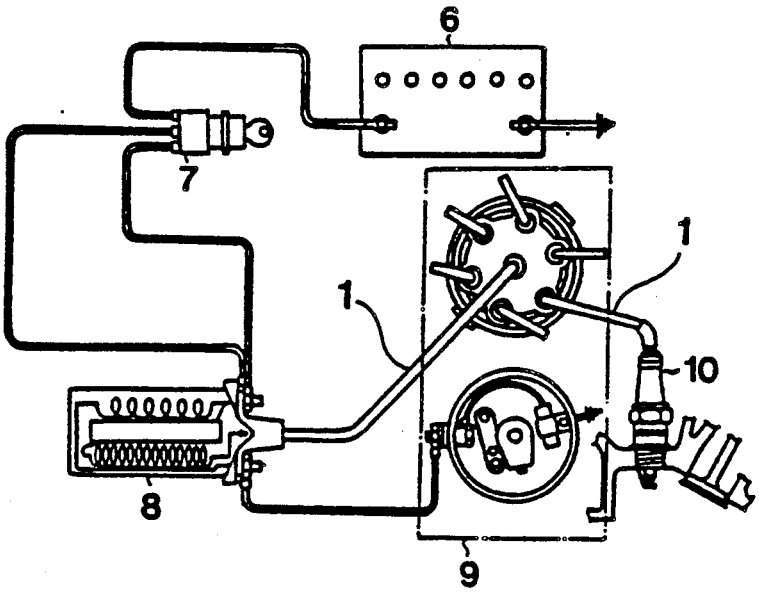
FIG. 2 is a plane view showing the ignition applied to an engine including ignition switch 7, ignition coil 8, distributor 9, and ignition plug 10.
Figure 3:
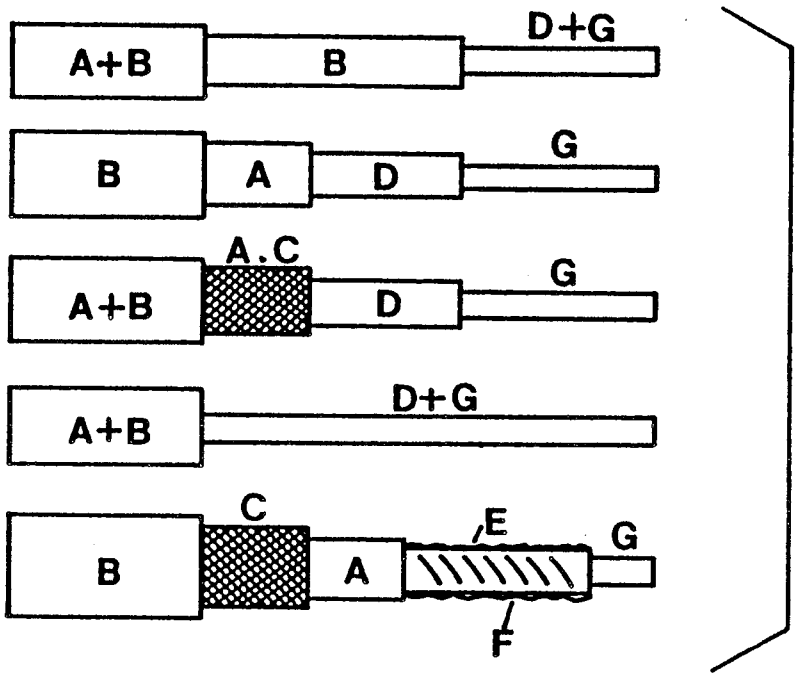
FIG. 3 illustrates ignition cables classified into five separate groups.
Figure 4:
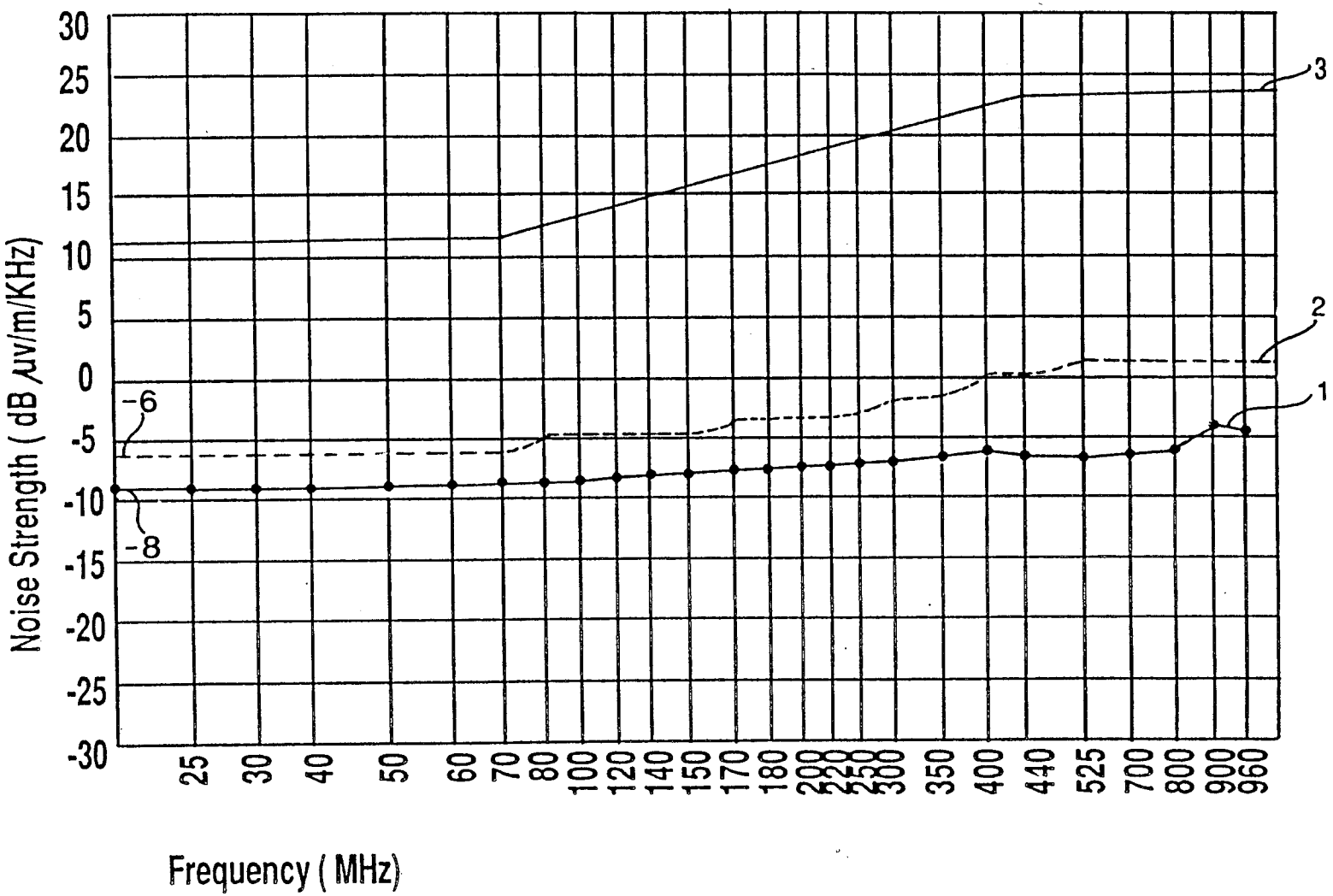
FIG. 4 is a graph illustrating the results of noise tests with the present invention.

In a conventional ignition cable (1), the surface of the conductive element (2) is coated with a coated layer (4), which is made of an insulator and a sheath, and an insulating layer (3), which is made of an insulator and inner-braid. However, in the instant invention, the above conductive element (2) is made of a carbon fiber of polyacrylo nitrile type comprised of the following structure:

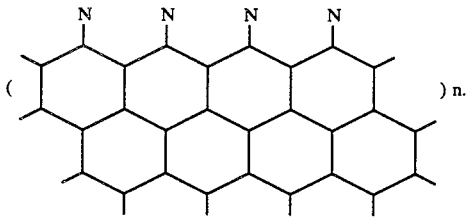

In addition, the surface of the conductive element (2) is coated with an electro-conductive layer (5). Such an electro-conductive layer (5) is made by a method in which a polyacrylo nitrile type carbon fiber powder is mixed with the conductive rubber of the synthetic resin in an appropriate ratio according to the required resistance value, whereby the electro-resistance value of the electro-conductive layer (5) can be readily adjusted.

In accordance with a second embodiment of the invention, the conductive element (2) can be made from the carbon fiber of viscose rayon type, or coal-tar, or petroleum pitch type.

As described above, this invention is composed of a polyacrylo nitrile (PAN) carbon fiber which is made by method in which a polyacrylo nitrile is carbonized in the nitrogen atmosphere.

The chemical structure of the polyacrylo nitrile differs from the chemical structure of the conventional carbon black in the conventional ignition cable.

Therefore, the ignition cable, according to the instant invention, absorbs the high frequency noise generated due to high voltage, because the structure of the polyacrylo nitrile carbon fiber is elastic and the electrical characteristics are far superior to those of conventional carbon black.

In this invention, by substituting the polyacrylo nitrile carbon fiber for the glass fiber, aramide fiber and carbon black, which constitute the conductive element of ignition cable, and by coating the conductive layer (5) which is made by that PAN type carbon fiber powder is mixed with the conductive rubber or synthetic resin on the conductive element (2), the conductivity of the conductive element (2) (anti-tension part) and conductive layer (5) are raised, while at the same time the high frequency noise is prevented.

The results of noise tests with the present invention are set forth in Table I as follows:

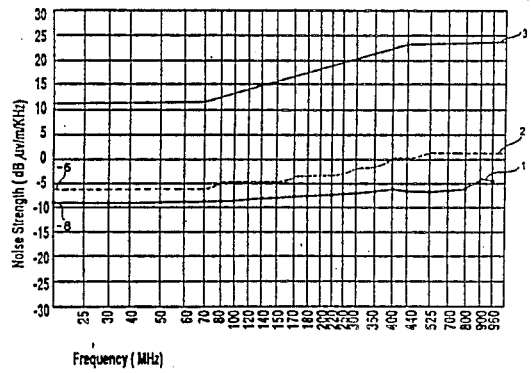

Graph line 1—Noise level of the present invention.
Graph line 2—Noise level of the surrounding environment.
Graph line 3—Critical noise level for the International SAE Standard.

The measurement apparatus utilized included a VHF measuring device manufactured by Anritsu Electric Co. of Japan, Model No. M-3217, and a UHF measuring device manufactured by Potamac Instruments Inc. of the U.S.A., Model No. F/M-72. As proven in the above test, the noise level resulting from use of the instant invention is −8 db, which is far lower than the critical noise of the intentional standard (SAE).

From the foregoing, it is clear that the polyacrylo nitrile type carbon fiber absorbs noise as an ultra electro-conductive material in place of the former conventional glass fiber or carbon black for the anti-tension part of the cable. As the electro-conductive layer (5) is made by method in which the polyacrylo nitrile type carbon fiber powder is properly mixed with the conductive rubber or the synthetic resin in appropriate ratio according to the required electro-resistance value, the ultra electro-conductive ignition cable of the instant invention prevents high frequency noise, while maintaining a zero Ohm/m to 160 Kohm/m range resistance value. Therefore, an unwanted interference due to the high frequency noise which harms the electrical components of an automobile is prevented, and because of the lowered resistance value, high current is supplied to the spark plug and a strong spark is generated. As the mixed fuel (gasoline:air = 1:15) in the cylinder is perfectly combusted, pollution is minimized and engine horse power is maximized.

Accordingly, the present invention, which provides a low electro-resistance material (16 Kohm/m-Zero Ohms/m) solves the defect of the conventional high electro-resistance cable (16 Kohm/m range) while, at the same time, efficiency for preventing unwanted noise is much improved.

What is claimed is:

1. An improved engine ignition cable comprising a conductive element (2), which is coated with a coated layer (4) and an insulating layer (3), said insulating layer (3) is made of insulator material and an inner braid, said coated layer (4) is made of an insulator and a sheath; said improvement comprising said conductive element (2) comprising carbon fiber of polyacrylo nitrile type having a structure as

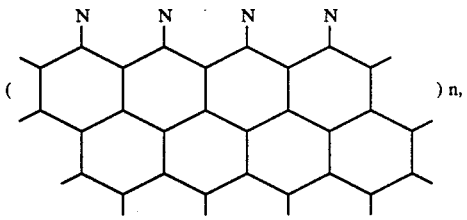

said polyacrylo nitrile type carbon fiber structure having excellent absorbability for high frequency noise, said conductive element (2) further coated with an electro-conductive layer (5) comprising a mixture of carbon fiber powder of polyacrylo nitrile type and conductive rubber mixed in accordance with a predetermined ratio to achieve a predetermined resistance value.

2. An engine ignition cable according to claim 1, wherein said conductive element (2) is made of carbonized carbon fiber of viscose rayon type.

3. An engine ignition cable according to claim 1, wherein said conductive (2) is made of carbon fiber of coal-tar or petroleum pitch type.

4. An engine ignition cable in accordance with claim 1, wherein said carbon fiber powder of polyacrylo nitrile type is mixed with synthetic resin.

* * * * *